US005967237A

United States Patent [19]

Sundholm

[11] Patent Number: 5,967,237

[45] Date of Patent: Oct. 19, 1999

[54] SPRINKLER

[76] Inventor: Göran Sundholm, Ilmari Kiannonkuja 3, FIN-04310 Tuusula, Finland

[21] Appl. No.: 08/732,282

[22] PCT Filed: May 17, 1995

[86] PCT No.: PCT/FI95/00260

§ 371 Date: Oct. 31, 1996

§ 102(e) Date: Oct. 31, 1996

[87] PCT Pub. No.: WO95/31252

PCT Pub. Date: Nov. 23, 1995

[30] Foreign Application Priority Data

May 17, 1994 [FI] Finland ..... 942299
Jun. 6, 1994 [FI] Finland ..... 942667

[51] Int. Cl.[6] ..... A62C 37/14

[52] U.S. Cl. ..... 169/37; 169/38

[58] Field of Search ..... 169/37, 38

[56] References Cited

U.S. PATENT DOCUMENTS

| | | | |
|---|---|---|---|
| 3,584,689 | 6/1971 | Williams | 169/37 |
| 4,175,677 | 11/1979 | Poeschl et al. | 222/5 |
| 4,597,451 | 7/1986 | Moore et al. | 169/61 |
| 5,188,185 | 2/1993 | Mears | 169/37 |
| 5,573,065 | 11/1996 | Sundholm | 169/37 |

FOREIGN PATENT DOCUMENTS

| | | | |
|---|---|---|---|
| 522258 | 5/1992 | European Pat. Off. . | |
| 2548850 | 6/1976 | Germany . | |
| 2533354 | 1/1977 | Germany . | |
| 4225997 | 2/1994 | Germany . | |
| 423317 | 5/1982 | Sweden . | |
| 501267 | 12/1994 | Sweden . | |
| 92015370 | 9/1992 | WIPO | 169/37 |
| 9215370 | 9/1992 | WIPO . | |
| 9220453 | 11/1992 | WIPO . | |
| 93021998 A1 | 11/1993 | WIPO | 169/38 |
| 9406567 | 3/1994 | WIPO . | |

*Primary Examiner*—Gary C. Hoge
*Attorney, Agent, or Firm*—Ladas & Parry

[57] ABSTRACT

The invention relates to sprinkler comprising a frame (2, 8, 2', 2"), into which at least one nozzle (15, 15', 15") has been mounted, whereby the frame has a fluid inlet (5, 5', 5") and a passage (13, 13', 13") for conveying extinguishing medium to at least one nozzle (15, 15', 15"), whereby the sprinkler, in a standby state, has a heat-sensitive release means (22, 22', 22"), which is in contact with a spindle (16, 16', 16") slidably arranged in a conduit (13, 13', 13") having an inlet (11) and an outlet (14) to said nozzle. To provide a new sprinkler that ensures an even and straightlined load on the release means (22) without breaking the release means due to a high fluid pressure, the sprinkler is characterized in that the conduit is composed of a channel (13, 13', 13"), the wall of which the spindle (16, 16', 16") is arranged in a slidable or almost slidable contact with, and that the spindle and the channel extend on both sides of the channel (13, 13', 13") inlet (11, 11', 11") in order to at least partially balance the fluid pressure in the inlet when the sprinkler is in the standby state.

18 Claims, 7 Drawing Sheets

SPRINKLER

The present invention relates to a sprinkler having, in a standby state, a heat-sensitive release means, which is in contact with a spindle. More specifically, the invention relates to a sprinkler comprising a frame, into which at least one nozzle has been mounted, whereby the frame has a fluid inlet and a passage for conveying extinguishing medium to at least one nozzle, whereby the sprinkler, in the standby state, has a heat-sensitive release means, which is in contact with a spindle slidably arranged in a conduit having an inlet and an outlet to said nozzle.

The release means may be, for instance, a glass vial that explodes at an elevated temperature. To achieve a rapid release, it is desirable to make the vial as thin as possible. Even a thin vial is able to withstand a sufficiently high mechanical load at a normal temperature, provided that the load is located directly on the vial end and is even.

Such a sprinkler is previously known from SE 501,267. However, this known sprinkler does not permit a high fluid pressure to exist in the fluid inlet, when the sprinkler is in the standby position, to achieve a rapid release of the sprinkler, since the fluid pressure would exert on the release means a force so great that the release means would break; alternatively, the release means would require a special construction.

The object of the invention is to provide a new sprinkler that ensures an even and straightlined load on the release means, whereby the load is not so high that the release means could break merely as a result of the fluid pressure in the sprinkler when the sprinkler is in the standby position.

The sprinkler according to the invention is characterized in that the conduit is composed of a channel, the wall of which the spindle is arranged in a slidable or almost slidable contact with, and that the spindle and the channel extend on both sides of the channel inlet in order to at least partially balance the fluid pressure in the inlet when the sprinkler is in the standby state.

In a preferred embodiment, the nozzles, the release means and the spindle are mounted into an insert housing, which thus premounted can in turn be mounted into a sprinkler retaining housing having a fluid inlet, which is in contact with the fluid inlet of the insert housing. It is thus easy to perform the mounting carefully without causing any damage to a vial sensitive to impacts and uneven load.

The preferred embodiments of the invention are described in the enclosed claims 2–12.

The invention will be described in greater detail below with reference to the preferred embodiments illustrated in the enclosed drawing.

Figure 1:
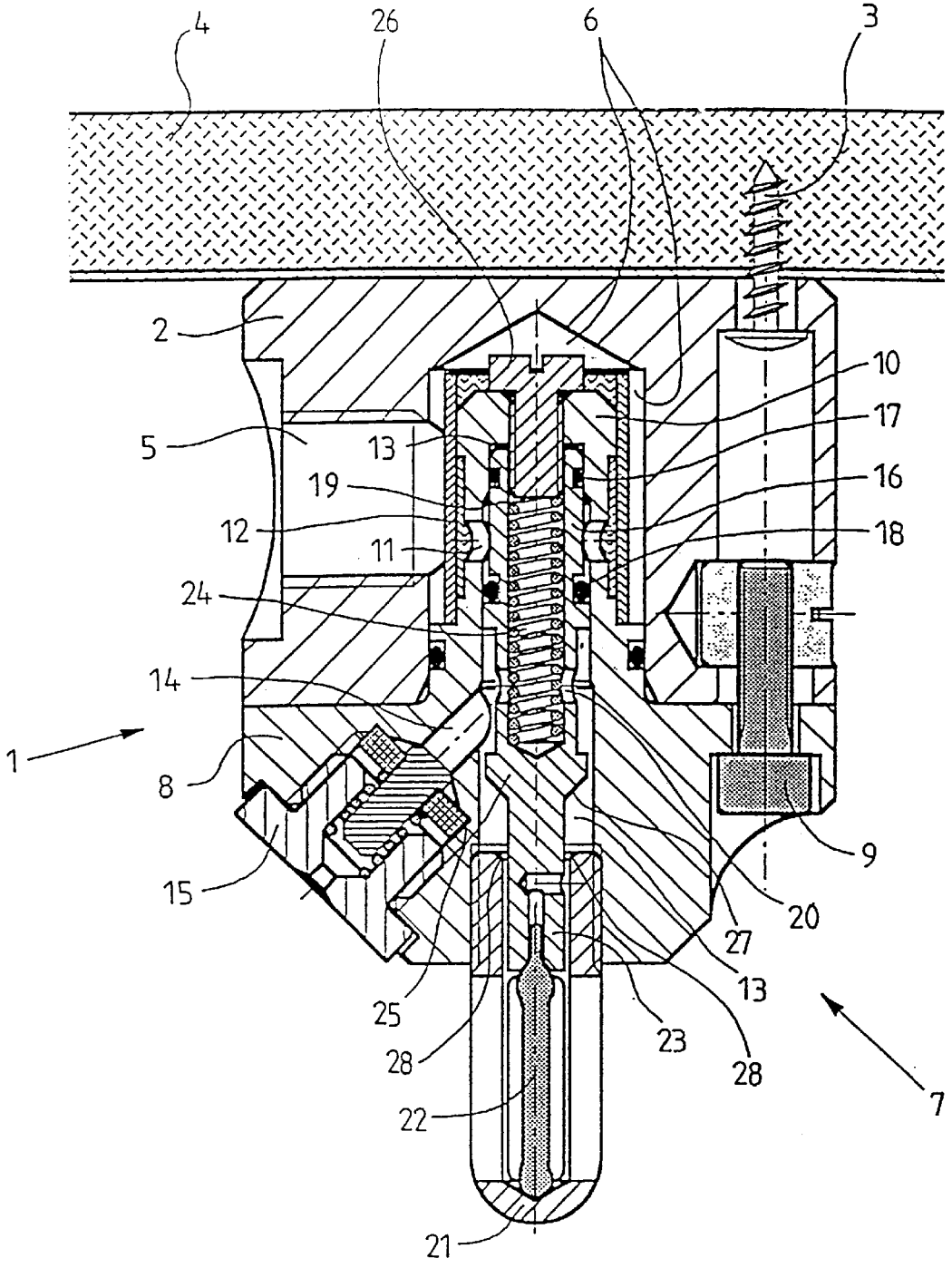
FIG. 1 shows a longitudinal section of a first embodiment of the invention in the standby state.
Figure 2:
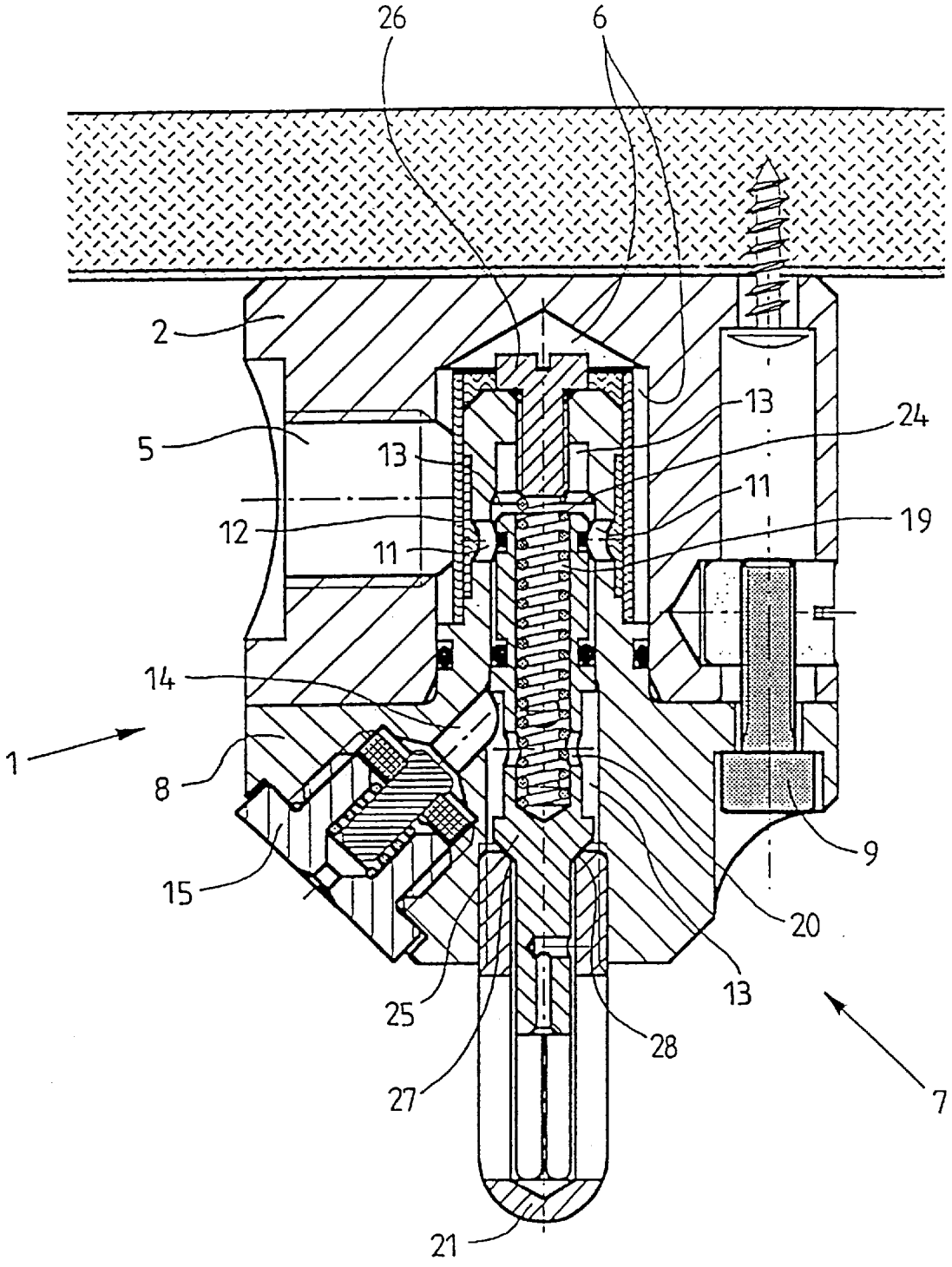
FIG. 2 shows the sprinkler according to FIG. 1 in the released state.

In FIGS. 1 and 2, a sprinkler is generally indicated by 1. The sprinkler has a housing 2, which is fastened to a ceiling 4 with a number of screws 3 and which has a fluid inlet 5 leading to a central channel 6. The sprinkler has further an insert 7 having an insert housing 8 fastened to the sprinkler housing 2 with a number of screws 9. Due to an insert housing 8, which can be detached from the sprinkler housing 2, the installation of the sprinkler is simple, hydrostatic tests on fluid tubes can be performed and the danger of mechanically deforming such components of the sprinkler that are sensitive to impacts is minimized. The insert 7 has a head 10, which is introduced into the central or receiving channel 6 and is sealed against the channel downstream of (after) the fluid inlet 5.

The head 10 of the insert housing 8 has an inlet composed of a number of inlet apertures 11, which via a filter 12 are in contact with the fluid inlet 5 and which lead to a fluid passage for fluid in the head 10, which fluid passage is in the form of a central channel 13, which via outlets or branchings 14 branches off to a number of oblique nozzles 15. In the channel 13 of the insert housing 8, a spindle 16 is slidably arranged, which spindle 16, in a standby position according to FIG. 1, is sealed by means of seals 17 and 18 against the head 10 on both sides of the fluid inlet apertures 11. The channel 13 extends on both sides of the fluid inlet apertures 11 to prevent the fluid pressure from exerting too great a downward force on the spindle 16 when the sprinkler is in the standby position.

The spindle 16 also has a central channel 19, which downstream of (after) the spindle seal 18 via side openings 20 is in contact with the channel 13 of the head 10 and from there via the branchings 14 with the nozzles 15.

A holder 21 for a heat-sensitive release means 22, such as a glass vial that is filled with fluid and that explodes at an elevated temperature, is mounted onto the bottom of the insert housing 8. The inner end of the vial 22 is fitted into the outer end section 23 of the spindle 16 and is loaded via the outer end section 23 by a spring 24 provided in the spindle channel 19. The end of the spring 24 near the vial 22 rests against the bottom of the spindle channel 19 at a shoulder 25, whereas the end of the spring opposite the vial rests against an adjusting screw 26 screwed into the head 10 or a corresponding adjustable stopper.

The force of the spring 24 and the annular surfaces at the seals 17, 18, which are under the influence of the fluid pressure in the inlet apertures 11, are adjusted so that they do not, in the standby position according to FIG. 1, crush the vial 22 at a normal temperature. The greater the difference of the annular areas at the seals 18 and 17, the greater is the force striving to press the spindle 16 downwards. If the part of the spindle 16 that is located between the seals 17 and 18 is in contact with the wall surrounding the head 10, a complete balance of the fluid pressure at the inlet apertures 11 exists; only the spring 24 presses the spindle. The balance of the fluid pressure does not have to be complete: a partial balance preventing too great a pressure—which could cause the vial to break—from being exerted on the vial suffices.

In the standby position according to FIG. 1, there is no fluid communication, due to the seal 17, from the inlet apertures 11 via the upper end of the channel 13 to the spindle channel 19 and further to the nozzles 15; the direct communication is closed by the seal 18.

If the vial 22 is crushed, as is the case in FIG. 2, due to hot gases or active heating by means of a heating coil (not shown), the force of the spring 24 hits the spindle 16 downwards. The spindle 16 has a shoulder 27 that restricts the downward movement of the spindle to the contact surface 28 of the holder 21 or—in the embodiment in FIG. 4—to the contact surface 28" of the insert housing 8". The shoulder 27 and the contact surface 28 form a sealing annular surface. The spindle 16 moves sufficiently far to provide a fluid communication from the inlet apertures 11 via the channel 13 in the head 10 to the spindle channel 19 and further to the nozzles 15, preferably with a great pressure and penetrating concentration in accordance with Patent Application PCT/FI92/00155 (WO publication number 92/20453).

Prior to mounting the insert 7 with the screws 9, the vial 22 and the spindle construction 16, including the spring 24, are put in place in the insert housing 8, whereafter the adjusting screw 26 is tightened to load the spring 24 by the desired amount. The insert 7 is then mounted as a complete unit. It is thus easy to perform the mounting carefully so that a vial sensitive to impacts or uneven load is not damaged.

Figure 3:
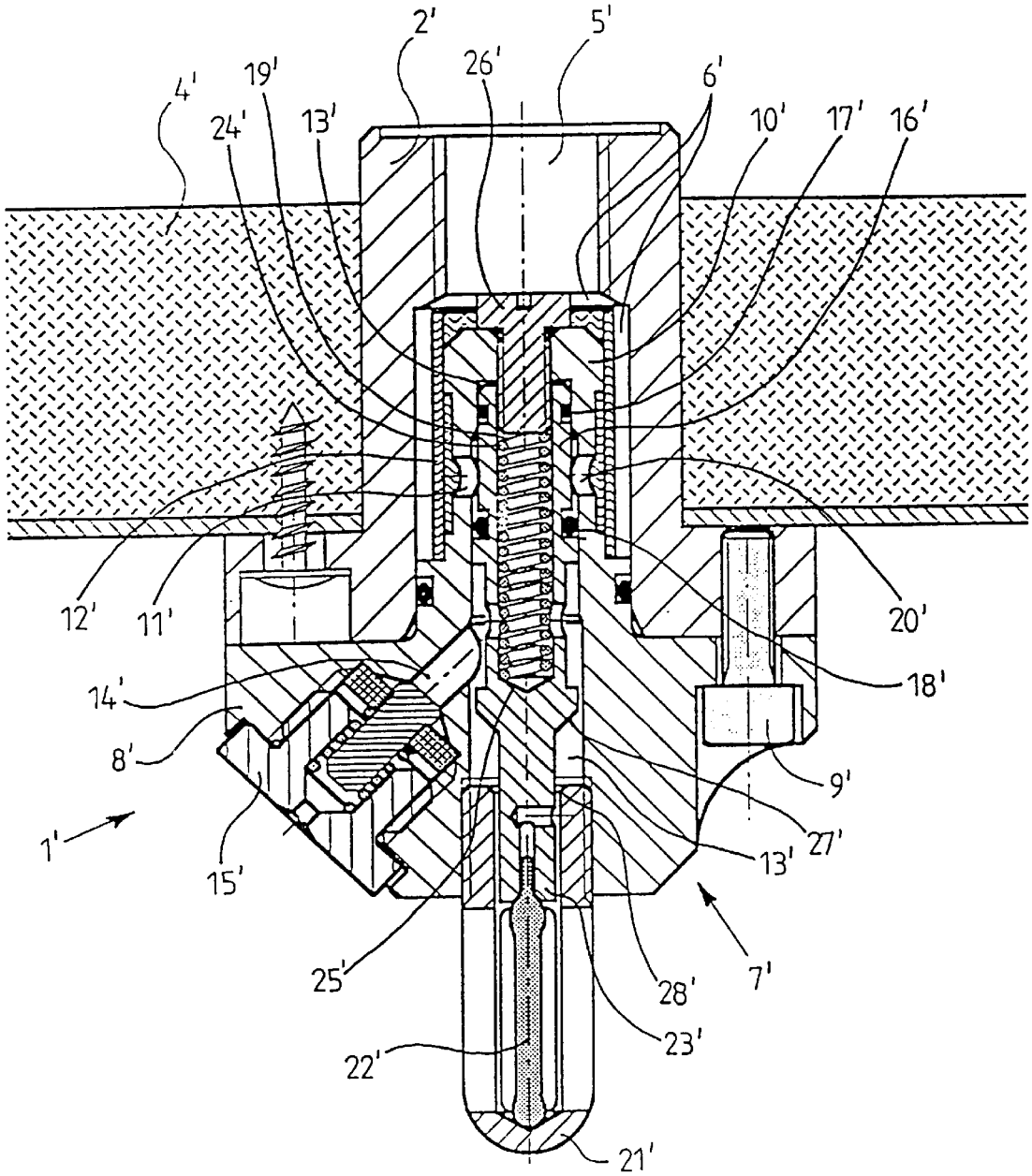
FIG. 3 shows a longitudinal section of a second embodiment of the invention in the standby state.

In the embodiment according to FIG. 3, the insert piece 7' of the sprinkler 1' corresponds to that in FIGS. 1 and 2. However, the housing 2' of the sprinkler having a fluid inlet 5' is passed through a ceiling 4'.

In FIG. 3, reference marks corresponding to those in FIG. 1 have been used for the corresponding components.

Figure 4:
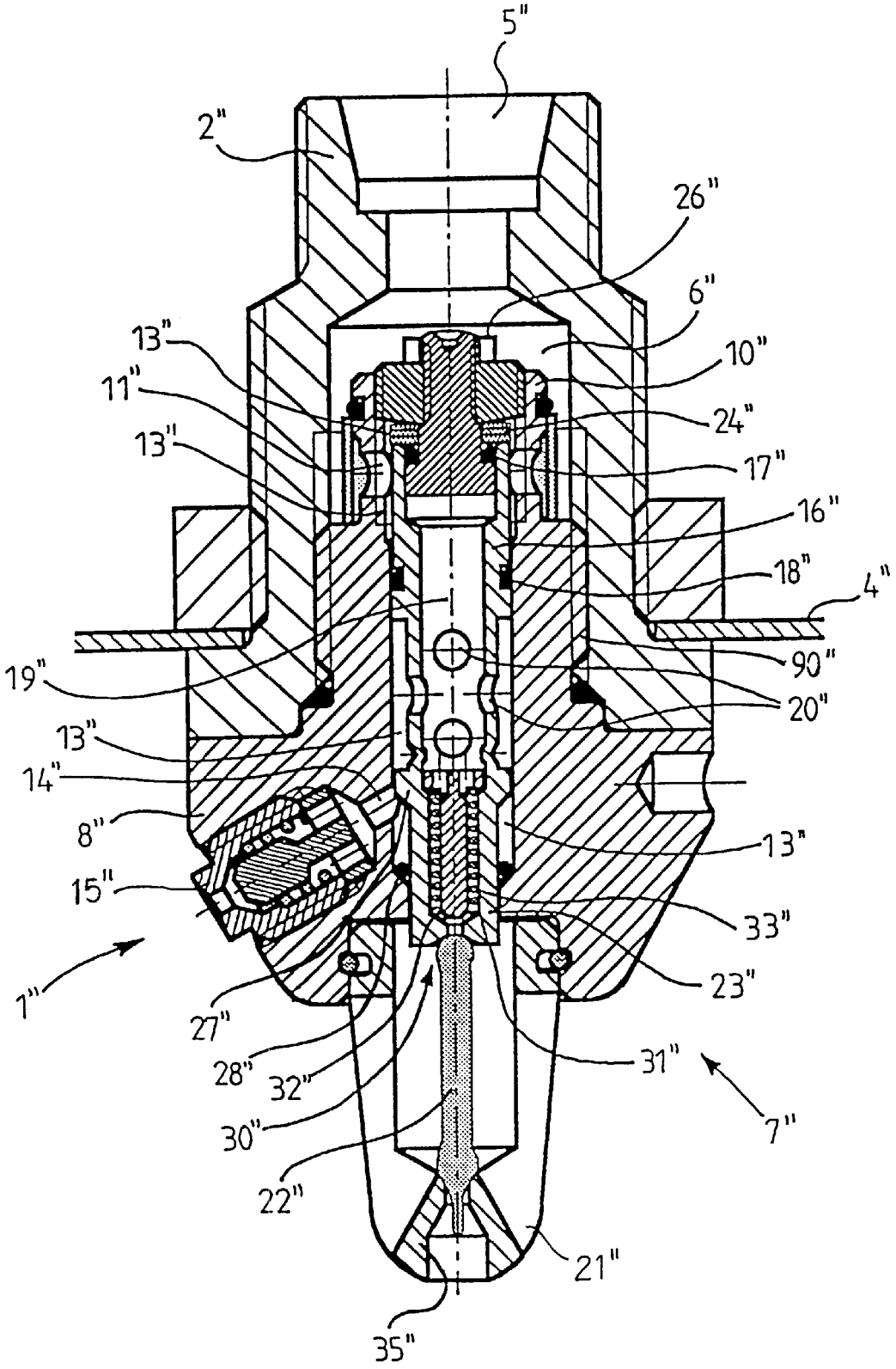
FIG. 4 shows a longitudinal section of a third embodiment of the invention in the standby state.
Figure 5:
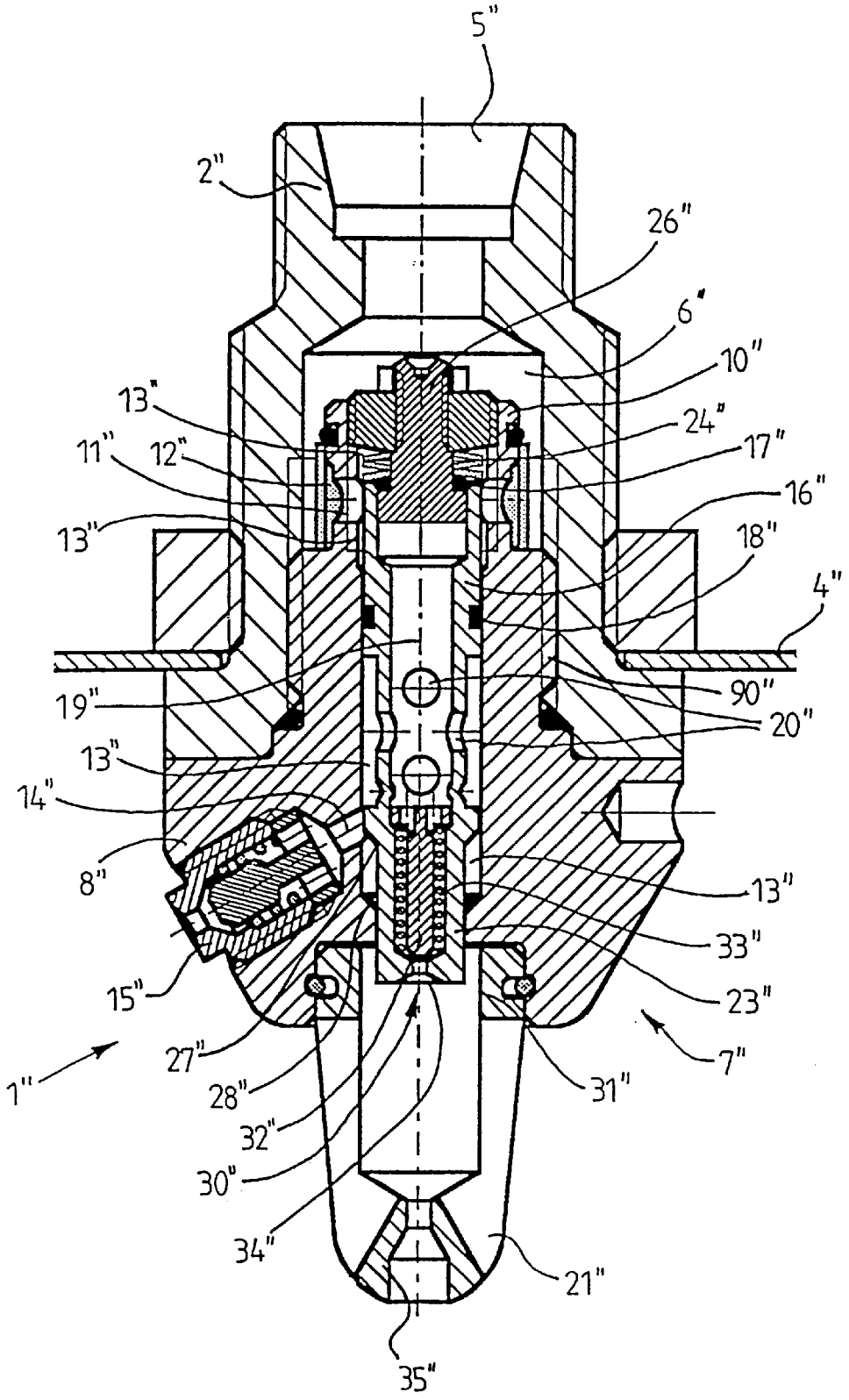
FIG. 5 shows the sprinkler according to FIG. 4 in an intermediate position shortly after the release means has broken.
Figure 6:
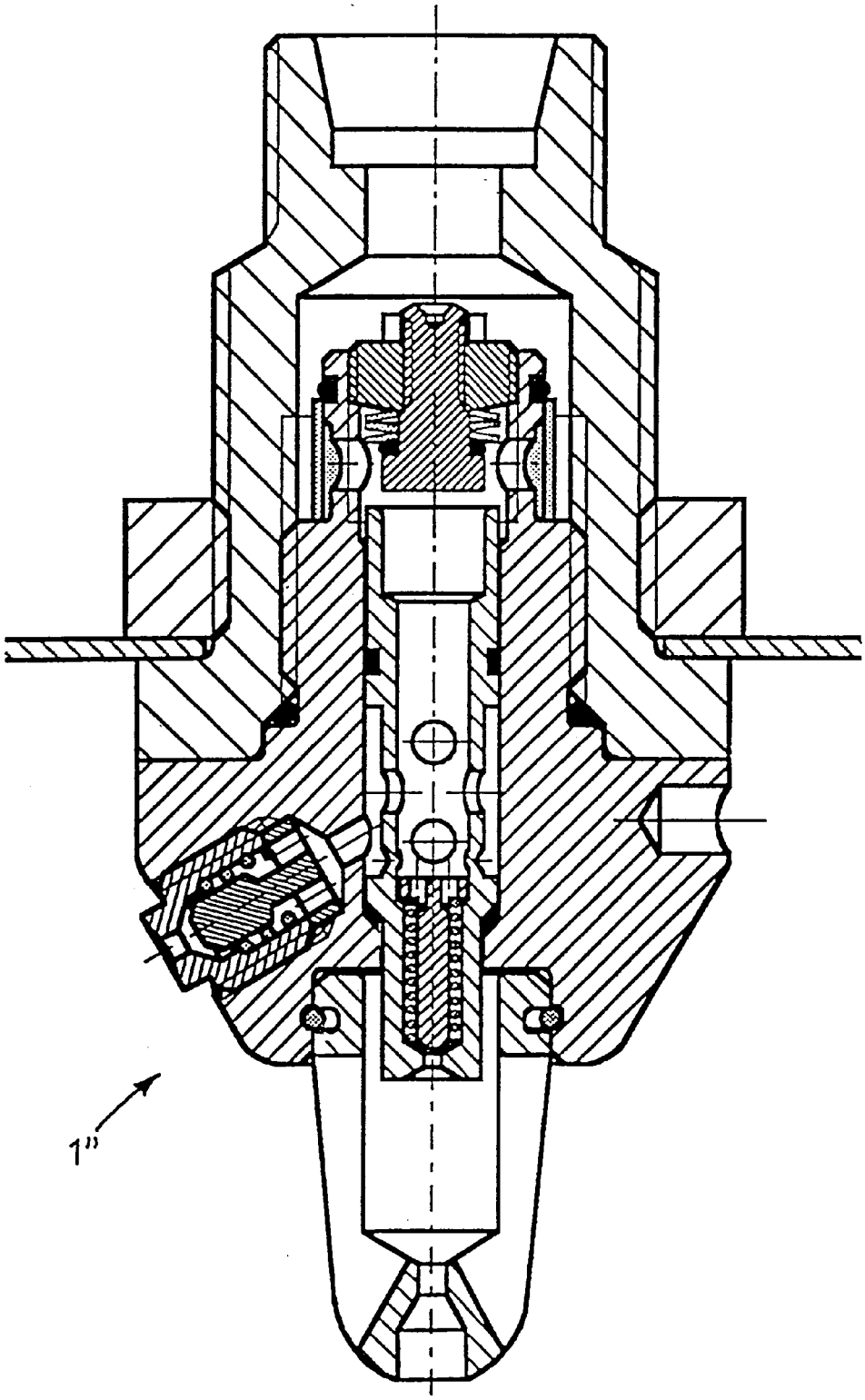
FIG. 6 shows the sprinkler according to FIG. 4 in a fully released state.
Figure 8:
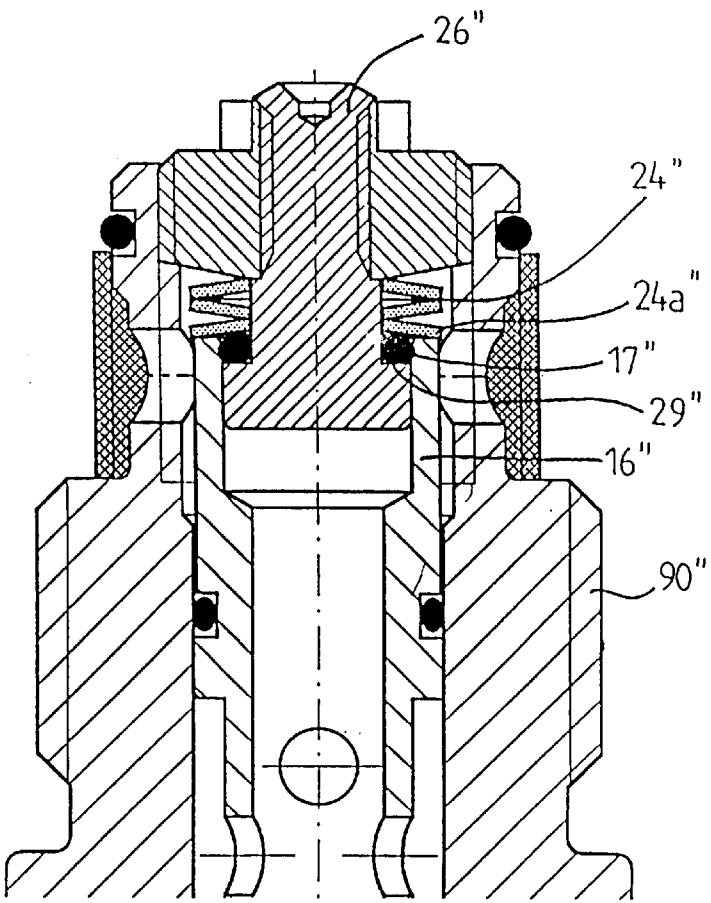
FIG. 8 shows a detail of the sprinkler in FIG. 5, i.e. in an intermediate position.
Figure 7:
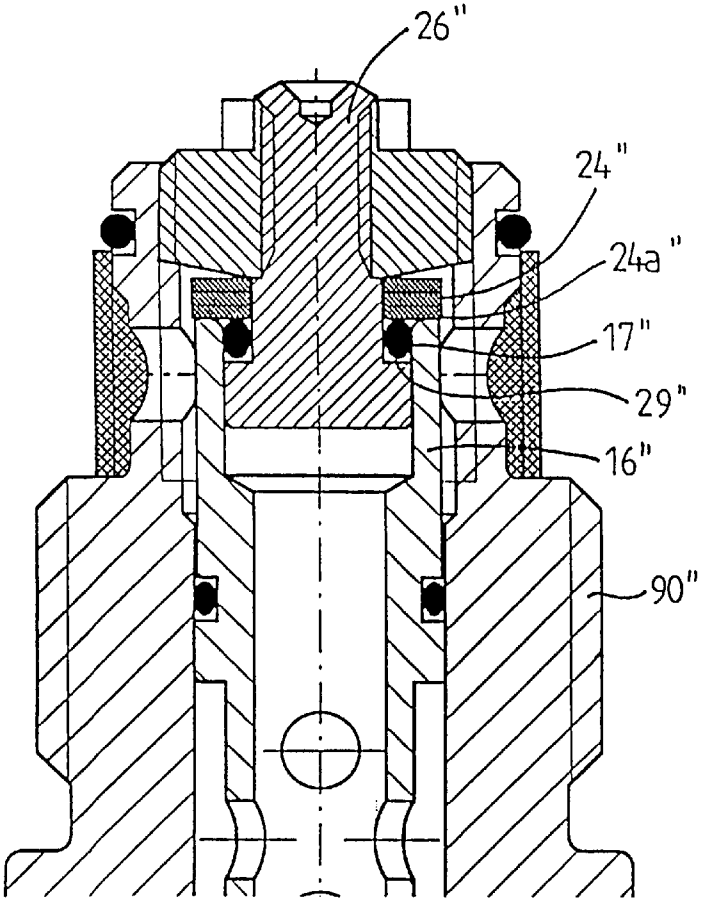
FIG. 7 shows a detail of the sprinkler in FIG. 4 in the standby state.

FIGS. 4–6 show a third embodiment of the invention in the standby position, in the intermediate position and in the fully released position. Reference marks corresponding to those in FIGS. 1 and 3 have been used in these figures for the corresponding components. The embodiment in FIG. 4 differs from the embodiments in FIGS. 1 and 3 as regards the position of the seal 17". When the sprinkler is in the standby position, the seal 17" is located close to the adjustable pin 26" at the upper edge of the spindle. In the embodiment according to FIG. 4, a spring 24" arranged above the spindle 16" replaces the spring 24, 24' in FIGS. 1 and 3. The spring 24", which is composed of Belleville springs, exerts a force against the upper end of the spindle 16" when the sprinkler 1" is in the standby position, see FIGS. 4 and 7. The seal 17" is located in a space defined by a shoulder 29" in the adjusting screw 26", the lowermost Belleville spring 24*a*" of the spring 24" and the upper end of the spindle channel 19", when the sprinkler 1" is in the standby position. When the vial 22" is crushed in the event of a fire, the spring 24" assumes the shape illustrated in FIGS. 6 and 8. In the fully released position of the sprinkler, see FIG. 6, the frustoconical shape of the Belleville spring 24*a*" holds the seal 17" pressed against the shoulder 29" in the adjusting screw 26". The Belleville spring 24*a*" is arranged to grip the seal 17" before the upper end of the spindle 16" passes the shoulder 29" of the adjusting screw 26", i.e. before the spindle 16" falls so low that the spindle channel 19" no longer surrounds the seal 17". Due to the Belleville spring 24*a*", the seal 17"—regardless of whether the sprinkler is in the standby or released position—is locked at the shoulder 29". Thus a high fluid pressure is not able to displace the seal 17" at the shoulder 29", when the sprinkler is in the fully released position, FIG. 6. Consequently, the spring 24" has two functions: the function of pressing down the spindle 16" and the function of keeping the seal 17" in place.

The embodiment in FIGS. 4–6 also differs from the embodiments in FIGS. 1 and 3 as a nozzle 30" has been formed in the lowermost part of the spindle channel 19", see FIG. 5. The nozzle 30" comprises a helical spring 31" surrounding a pin 32". Thus such a helical conduit 33" is formed that produces liquid mist from the diverging opening 34" of the nozzle 30". In the lower end of the holder 21", a channel and a diverging opening with a conical surface 35" have been formed. The liquid mist jet emitted from the fluid channel 33" continues via said surface 35" and is finally emitted by the sprinkler 1".

The embodiment in FIGS. 4–6 differs further from the embodiments in FIGS. 1 and 3 as the insert housing 8" is screwed on the sprinkler housing 2" by means of threads 90", which have been formed in the part of the insert housing located below the head 10". A very simple construction for fastening the insert housing in the sprinkler housing is achieved in this manner.

I claim:

1. A sprinkler comprising a frame (2, 8, 2', 2"), into which at least one nozzle (15, 15', 15") has been mounted, the frame having a fluid inlet (5, 5', 5") and a passage (13, 13', 13") for conveying extinguishing medium to the nozzle (15, 15',15", 30", 35"), the sprinkler, in a standby state, having a heat-sensitive release means (22, 22', 22"), which is in contact with a spindle (16, 16', 16") slidably arranged in a conduit (13, 13', 13") having an inlet (11, 11', 11") and an outlet (14, 14', 14") to the nozzle, the conduit being composed of a channel (13, 13', 13") having an inlet (11, 11', 11") and a wall, the spindle (16, 16', 16") being arranged in a slidable or almost slidable contact with the channel wall, and the spindle and the channel extending on both sides of the channel inlet (11, 11', 11") in order to at least partially balance fluid pressure acting on the spindle in the inlet when the sprinkler (1, 1',1") is in the standby state.

2. A sprinkler according to claim 1, further comprising first sealing means (18, 18', 18") for sealing the spindle (16, 16', 16") against the channel wall the first sealing means being positioned between the channel inlet (11, 11', 11") and the outlet (14, 14', 14") to the nozzle (15, 15', 15");

the spindle (16, 16', 16") having a central spindle channel (19, 19', 19") having an inflow end and downstream of the first sealing means (18, 18', 18") openings (20, 20', 20") to the surrounding channel (13, 13', 13"), the channel and having an open inflow end;

second sealing means (17, 17', 17") being provided for closing fluid communication between the channel inlet (11, 11', 11") and the inflow end of the spindle channel (19, 19', 19") when the sprinkler (1, 1', 1") is in the standby state; and the spindle being arranged to be displaced, when the sprinkler (1, 1', 1") is released, so that a connection is opened from the channel inlet (11, 11', 11") past the second sealing means (17, 17', 17") to the inflow end of the spindle channel (19, 19', 19").

3. The sprinkler according to claim 2, further comprising a spring (24, 24') for displacing the spindle (16, 16') when the sprinkler is released, said spring being positioned in the spindle channel (19, 19'), in such a way that is resting partly against the bottom (25, 25') of the spindle channel and partly against an adjustable fastening means (26, 26').

4. A sprinkler according to claim 2, further comprising a spring (24, 24', 24") for displacing the spindle and for opening fluid communication between the channel inlet (11, 11', 11") and the inflow end of the spindle channel (19, 19', 19") when the sprinkler is released.

5. A sprinkler according to claim 4, wherein the spring (24") is positioned above the spindle (16") to exert a force against the upper end of the spindle when the sprinkler (1") is in the standby state.

6. A sprinkler according to claim 4, wherein the adjustable fastening means (26") comprising a portion extending into the spindle channel (19"), the second sealing (17") being mounted near the portion when the sprinkler is in the standby position.

7. A sprinkler according to claim 6, wherein the spring (24") comprises a Belleville spring (24*a*"), which is arranged to press the second sealing means (17") against a shoulder (29") in the adjustable fastening means (26") in order to keep the second sealing means (17") in place.

8. A sprinkler according to claim 1 comprising several nozzles (15, 15', 15"), wherein nozzles (15, 15', 15"), the release means (22, 22', 22") and the spindle (16, 16', 16") are mounted in an insert housing (8, 8', 81"), mounting means (9, 9', 90") being provided for mounting the insert housing as a premounted part into the frame (2, 2', 2") and the channel inlet (11, 11', 11") being positioned in the insert housing.

9. A sprinkler according to claim 8, wherein the insert housing (8, 8', 8") comprises a head (10, 10', 10"), the channel inlet (11, 11', 11") being positioned in the head, and the frame (2, 2', 2") comprising a retaining housing (2, 2', 2") with a receiving channel (6, 6', 6") for receiving the head, the receiving channel (6, 6', 6") being in fluid communication with the fluid inlet (5, 51") of the frame.

10. A sprinkler according to claim 9, wherein the insert housing (8") comprises threads (90") for screwing the insert housing into the corresponding threads in the retaining housing (2").

11. A sprinkler according to claim 1 wherein the heat-sensitive release means (22") is positioned in the bottom of the frame (8"), the sprinkler comprising a holder (21") for the heat sensitive means, a nozzle (30") being arranged at the lower end of the spindle channel (19") for producing a liquid mist, and a helical fluid channel (33") defined by a helical spring (31") surrounding a pin (32") leading to said nozzle (30").

12. A sprinkler according to claim 10, the holder comprising a lower end, wherein the lower end comprises an opening (36") and a diverging surface (35") for receiving liquid mist from the nozzle (30") and for emitting the liquid mist from the sprinkler (1").

13. A sprinkler according to claim 2, comprising several nozzles (15, 15', 15"), characterized in that the nozzles (15, 15', 15"), the release means (22, 22', 22") and the spindle (16, 16', 16") having a fastening means (26, 26', 26") are mounted in an insert housing (8, 8', 8"), which thus premounted can in turn be mounted into the frame of the sprinkler (2, 2', 2") having a fluid inlet (5, 5', 5") that is in contact with the inlet (11, 11', 11") of the insert housing (8, 8', 8").

14. A sprinkler according to claim 3, comprising several nozzles (15, 15', 15"), characterized in that the nozzles (15, 15', 15"), the release means (22, 22', 22") and the spindle (16, 16', 16") having a fastening means (26, 26', 26") are mounted in an insert housing (8, 8', 8"), which thus premounted can in turn be mounted into the frame of the sprinkler (2, 2', 2") having a fluid inlet (5, 5', 5") that is in contact with the inlet (11, 11', 11") of the insert housing (8, 8', 8").

15. A sprinkler according to claim 4, comprising several nozzles (15, 15', 15"), characterized in that the nozzles (15, 15', 15"), the release means (22, 22', 22") and the spindle (16, 16', 16") having a fastening means (26, 26', 26") are mounted in an insert housing (8, 8', 8"), which thus premounted can in turn be mounted into the frame of the sprinkler (2, 2', 2") having a fluid inlet (5, 5', 5") that is in contact with the inlet (11, 11', 11") of the insert housing (8, 8', 8").

16. A sprinkler according to claim 5, comprising several nozzles (15, 15', 15"), characterized in that the nozzles (15, 15', 15"), the release means (22, 22', 22") and the spindle (16, 16', 16") having a fastening means (26, 26', 26") are mounted in an insert housing (8, 8', 8"), which thus premounted can in turn be mounted into the frame of the sprinkler (2, 2', 2") having a fluid inlet (5, 5', 5") that is in contact with the inlet (11, 11', 11") of the insert housing (8, 8', 8").

17. A sprinkler according to claim 6, comprising several nozzles (15, 15', 15"), characterized in that the nozzles (15, 15', 15"), the release means (22, 22', 22") and the spindle (16, 16', 16") having a fastening means (26, 26', 26") are mounted in an insert housing (8, 8', 8"), which thus premounted can in turn be mounted into the frame of the sprinkler (2, 2', 2") having a fluid inlet (5, 5', 5") that is in contact with the inlet (11, 11', 11") of the insert housing (8, 8', 8").

18. A sprinkler according to claim 7, comprising several nozzles (15, 15', 15"), characterized in that the nozzles (15, 15', 15"), the release means (22, 22', 22") and the spindle (16, 16', 16") having a fastening means (26, 26', 26") are mounted in an insert housing (8, 8', 8"), which thus premounted can in turn be mounted into the frame of the sprinkler (2, 2', 2") having a fluid inlet (5, 5', 5") that is in contact with the inlet (11, 11', 11") of the insert housing (8, 8', 8").

* * * * *